US009926133B1

(12) United States Patent
Alrumaih

(10) Patent No.: US 9,926,133 B1
(45) Date of Patent: Mar. 27, 2018

(54) TRASH BAG HOLDER

(71) Applicant: Abdulaziz Alrumaih, Kuwait (KW)

(72) Inventor: Abdulaziz Alrumaih, Kuwait (KW)

( * ) Notice: Subject to any disclaimer, the term of this patent is extended or adjusted under 35 U.S.C. 154(b) by 0 days.

(21) Appl. No.: 15/714,967

(22) Filed: Sep. 25, 2017

Related U.S. Application Data

(60) Provisional application No. 62/400,636, filed on Sep. 28, 2016.

(51) Int. Cl.
*B65F 1/14* (2006.01)

(52) U.S. Cl.
CPC ..... *B65F 1/1415* (2013.01); *B65F 1/1473* (2013.01); *B65F 2220/1066* (2013.01)

(58) Field of Classification Search
CPC ... A47L 13/52; E01H 1/12; E01H 2001/1293; B65F 1/1415; B65F 1/10; B65F 2220/1066; B65F 1/1473; B65B 67/1238; B65B 67/1227; B65B 67/12
USPC ..... 294/210
See application file for complete search history.

(56) References Cited

U.S. PATENT DOCUMENTS 4,457,549 A 7/1984 Lowery
4,787,753 A 11/1988 Barnhart
5,031,948 A * 7/1991 Groth ..... B65B 67/1233 141/108
5,456,431 A 10/1995 Ilnisky
5,913,496 A 6/1999 Valdez
6,131,861 A 10/2000 Fortier, Jr. et al.
6,209,596 B1 4/2001 Wong
6,382,573 B1 5/2002 Cepeda
6,416,023 B1 7/2002 Satsky
7,661,635 B2 2/2010 McConnell
D650,543 S 12/2011 Smart
8,267,358 B1 9/2012 Letson
8,422,716 B2 4/2013 Wetzel
8,851,542 B2 10/2014 Faraone
8,919,708 B1 12/2014 Graves
9,314,920 B1 * 4/2016 Jutras, Jr. ..... F21V 33/0084
2008/0309038 A1 12/2008 Gilligan

FOREIGN PATENT DOCUMENTS

GB 2 214 890 A 9/1989

* cited by examiner

*Primary Examiner* — Stephen Vu
(74) *Attorney, Agent, or Firm* — Richard C. Litman

(57) ABSTRACT

The trash bag holder includes a substantially rectangular two-part frame assembly for clamping the trash bag in an open position, the frame assembly including an upper frame member and a lower frame member. A pair of latches releasably secure the upper frame and the lower frame to each other with the open mouth of the bag clamped between the members. The holder may include a telescoping handle rotatably attached to the frame assembly, the handle being pivotal between an extended position for holding the open mouth of the bag while sweeping trash into the bag with a broom and a retracted position against the frame assembly when not in use. The trash bag holder may include a vertical, open frame stand, which may have casters for portability, the stand having parallel arms defining a ledge for supporting the frame assembly with the bag hanging open between the arms.

13 Claims, 9 Drawing Sheets

TRASH BAG HOLDER

CROSS-REFERENCE TO RELATED APPLICATION

This application claims the benefit of U.S. Provisional Patent Application Ser. No. 62/400,636, filed on Sep. 28, 2016.

BACKGROUND

1. Field

The present invention relates to refuse collection, and in particular, to a trash bag holder having an adjustable handle that allows users to easily collect trash and a stand for supporting the trash bag.

2. Description of the Related Art

The ubiquitous plastic trash bag is most frequently used as a disposable liner for a conventional trash can, either portably or fixed. The bag is usually only held open loosely by folding the mouth of the bag over the rim of the trash can or receptacle. Devices to ensure that the trash bag stays open while trash is being deposited therein are typically limited to clips or elastic bands that secure the mouth of the bag to the rim of the receptacle. When there is a considerable quantity of trash lying on the ground, it is often necessary to bend over frequently to pick up handfuls of trash, straighten up, deposit the trash in the trash can lined with the trash bag, and keep repeating the process until the area is cleared. The repetitious bending may make the back sore or aggravate pre-existing conditions, and may be difficult for individuals with disabilities. The alternative is to remove the trash bag from the trash can or receptacle, squat or kneel at ground level, and try to keep the bag open wide enough while scooping trash into the bag, an often vain and frustrating task. Thus, a trash bag holder solving the aforementioned problems is desired.

SUMMARY

The trash bag holder includes a substantially rectangular two-part frame assembly for clamping the trash bag in an open position, the frame assembly including an upper frame member and a lower frame member. A pair of latches releasably secure the upper frame and the lower frame to each other with the open mouth of the bag clamped between the members. The holder may include a telescoping handle rotatably attached to the frame assembly, the handle being pivotal between an extended position for holding the open mouth of the bag while sweeping trash into the bag with a broom, and a retracted position against the frame assembly when not in use. The trash bag holder may include a vertical, open frame stand, which may have casters for portability, the stand having parallel arms defining a ledge for supporting the frame assembly with the bag hanging open between the arms.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
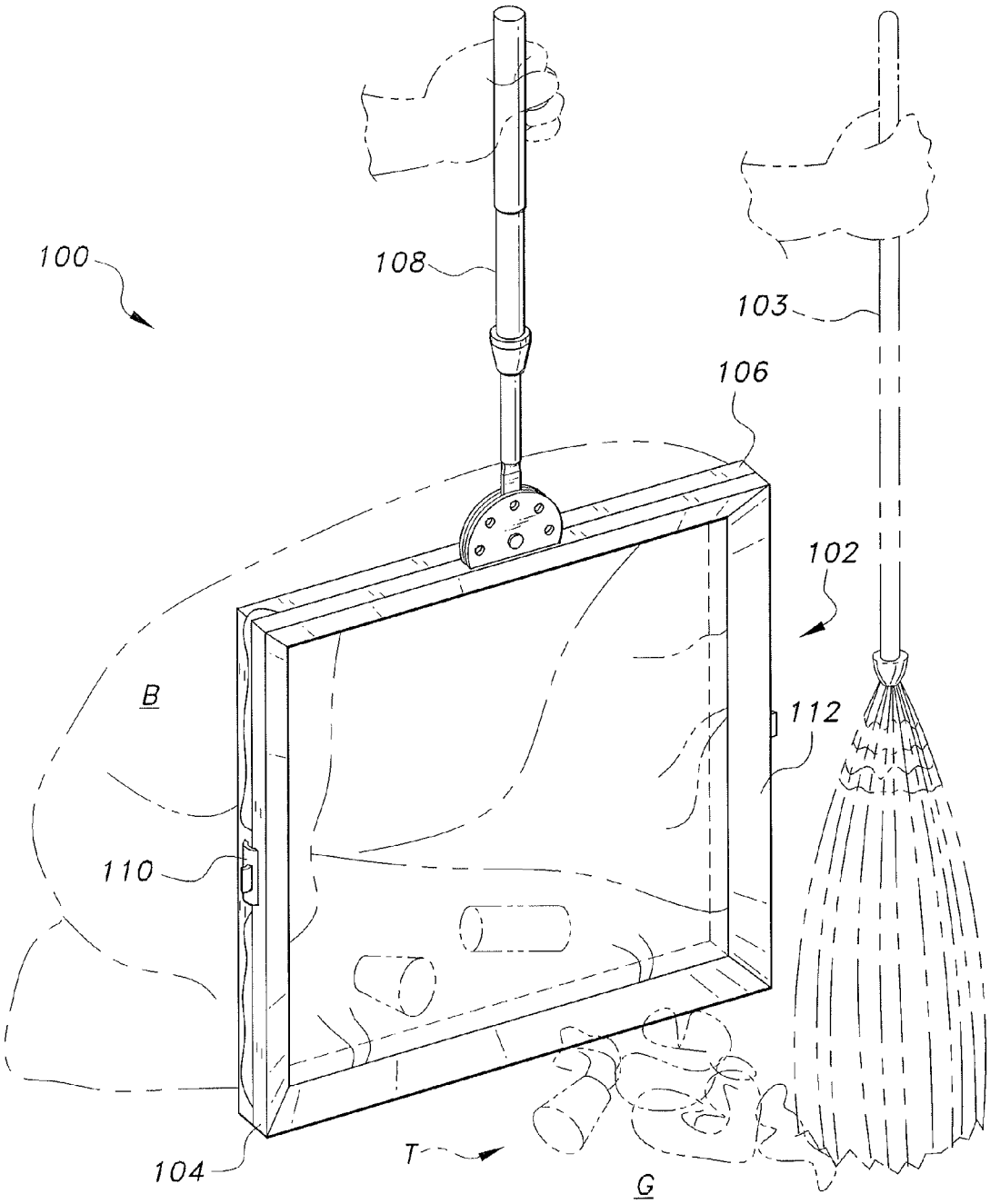
FIG. 1 is an environmental perspective view of a trash bag holder, showing the holder in use while removing trash from the ground.

An exemplary trash bag holder 100 is shown in FIGS. 1-6C. As shown in FIGS. 1-3C, the trash bag holder 100 includes a substantially rectangular frame assembly 102 for holding the trash bag B in an open position, such that trash T on the ground G can be swept into the bag B using, for example, a broom 103, while the trash bag holder 100 is in a generally vertical orientation. The main frame 102 includes an upper frame member 104, a lower frame member 106, and first and second latches 110 for selectively clamping the upper frame member 104 and the lower frame member 106 together. The open mouth of the trash bag B is inserted between the upper and lower frame members 104, 106 before the latches 110 are fastened so that the mouth of the trash bag B is held in an open position when the upper 104 and the lower 106 frame members are clamped together. In the drawings, the portion of the bag B that would be covering the lower frame member 106 has been omitted to allow viewing the trash bag holder's 100 components. A telescoping handle 108 is shown rotatably attached to a first side of the upper frame member 104. While this placement of the handle 108 avoids interference from the open mouth of the bag B, it should be understood that the telescoping handle 108 could be rotatably attached to the lower frame member 106. The upper frame member 104 includes a beveled upper surface 112 that acts as an upwardly oriented ramp in the position shown in FIG. 1 to assist in directing trash T up and into the trash bag B.

Figure 2:
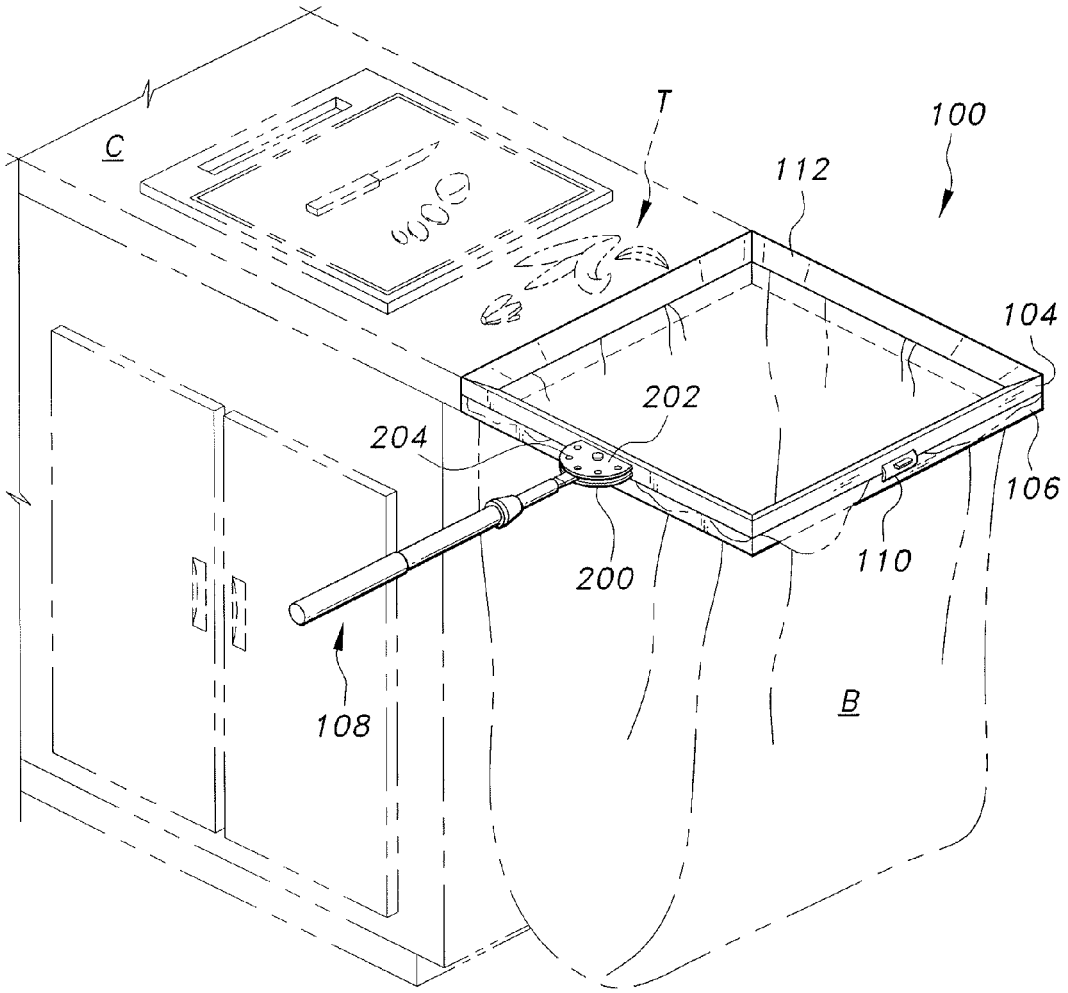
FIG. 2 is an environmental perspective view of the trash bag holder of FIG. 1, showing the holder in use while removing trash from a counter.

FIG. 2 shows the trash bag holder 100 configured in a generally horizontal position for removing trash T from a horizontal surface, such as a countertop C. In this position, the beveled upper surface 112 of upper frame member 104 acts as a downwardly oriented ramp to assist in directing trash T down into the trash bag B.

Figure 3A:
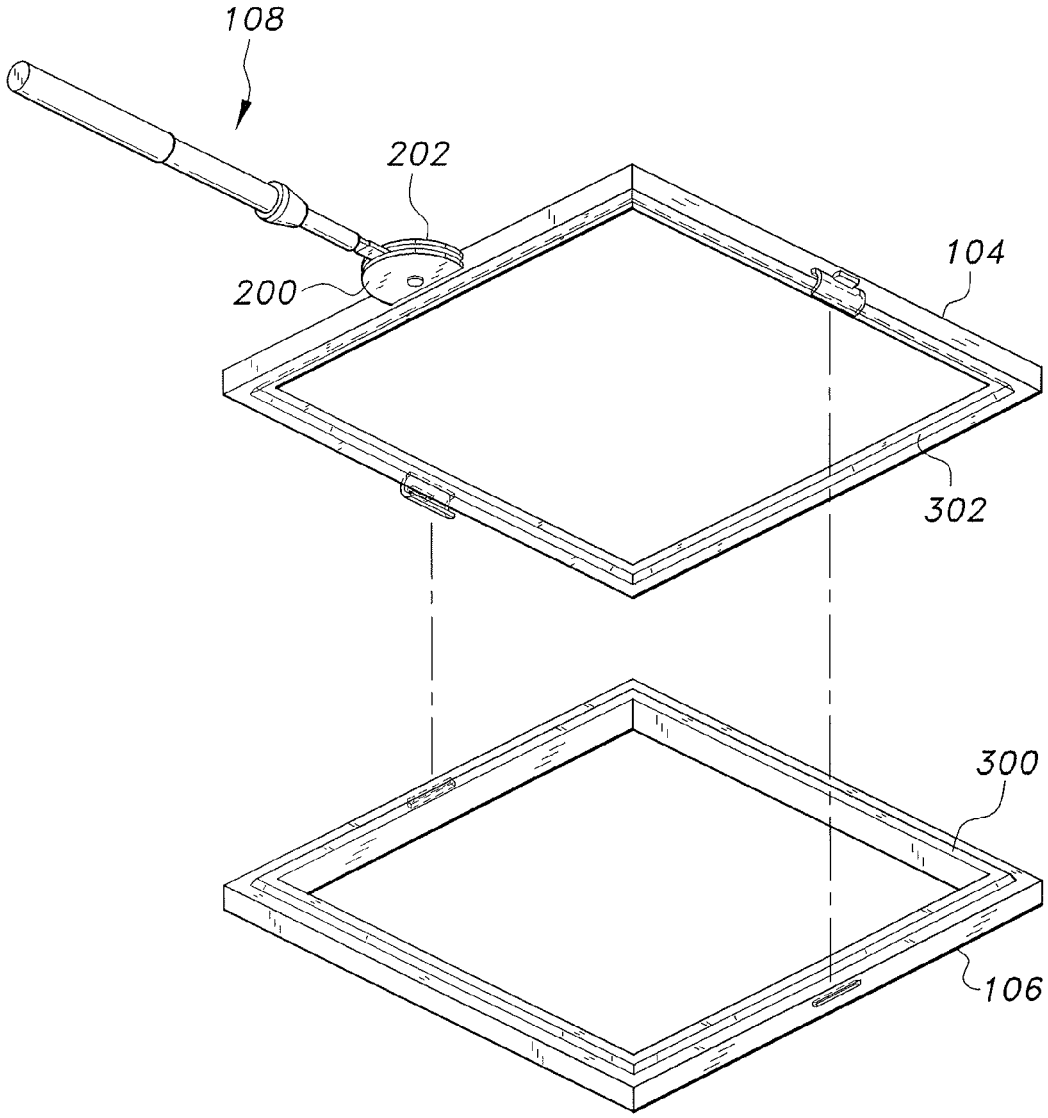
FIG. 3A is a perspective view of the frame assembly of the trash bag holder of FIG. 1.
Figure 3B:
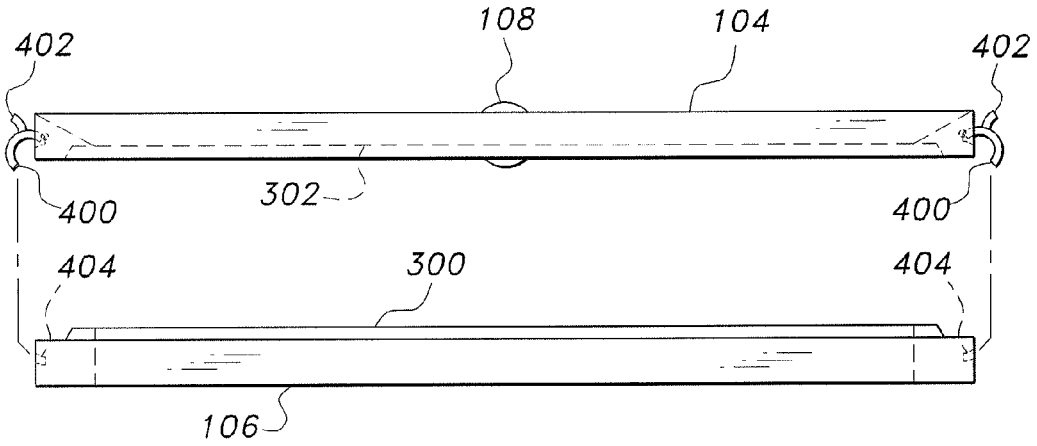
FIG. 3B is a side view of the frame assembly of FIG. 3A, shown in a separated position.
Figure 3C:
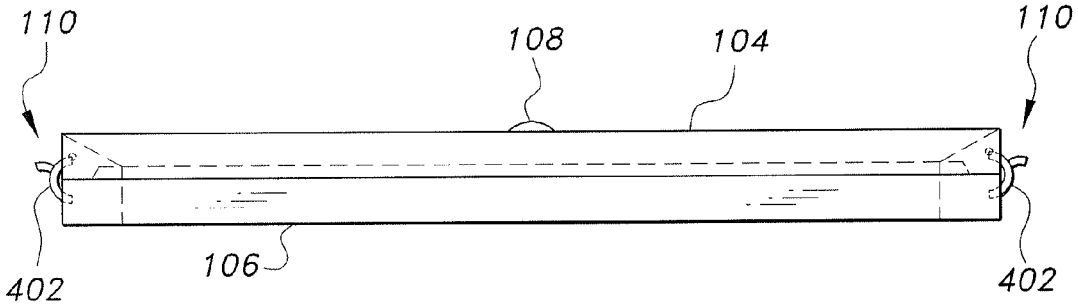
FIG. 3C is a side view of the frame assembly of FIG. 3A, shown with the frame members latched together.

FIGS. 3A-3C show the upper frame member 104 and the lower frame member 106 in different orientations to one another. As can be seen in FIGS. 3A and 3B, the upper surface of the lower frame 106, includes a beveled perimeter surface 300 that extends into a complementary beveled perimeter groove or receptacle 302 in the lower surface of the upper frame member 104. This configuration firmly clamps mouth of the bag B sandwiched between the upper and lower frame members 104, 106. As best seen in FIGS. 3B and 3C, each of the first and second latches 110 includes a hook member 400 pivotally attached to opposite sides of the upper frame member 104. Each of the first and second latches 110 also includes a catch member 404 attached to the corresponding side of the lower frame member 106. When the latches 110 are fastened, the hook members 400 engage the catch members 404, as shown in FIG. 3C. In addition, each of the first and second latches 110 include a release lever 402, such that pressing the release lever 402 disengages the hook member 400 from its associated catch member 404, thereby releasing the upper 104 and lower 106 frame members from each other to allow removal or insertion of a bag therebetween.

Figure 4:
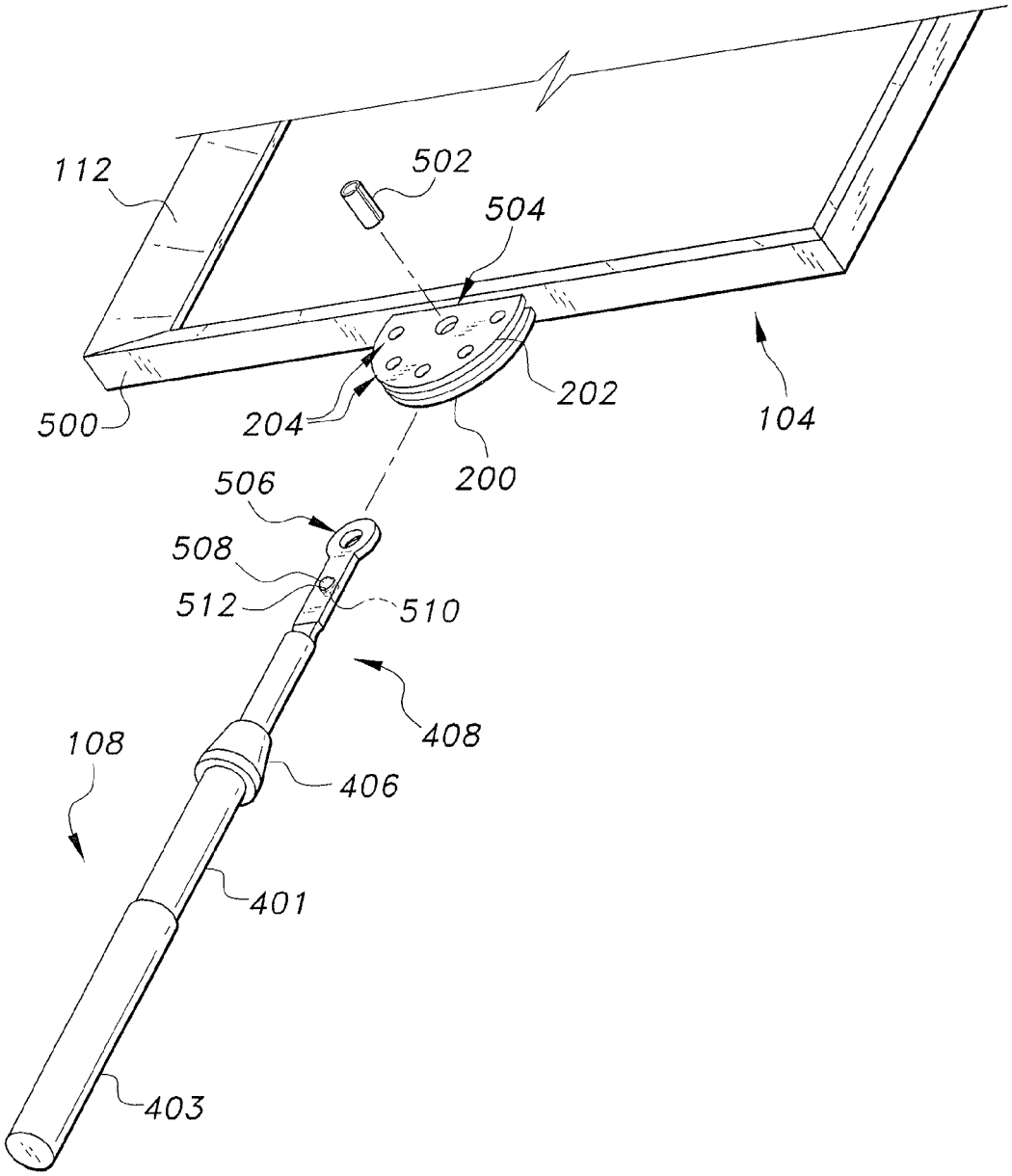
FIG. 4 is a partial perspective view of the trash bag holder of FIG. 1, shown with the handle exploded from the frame members.

As best seen in FIG. 4, the trash bag holder 100 also includes a handle mounting assembly, which includes a first semicircular plate 200 attached to the front 500 of the upper frame member 104. A second semicircular plate 202 is also attached to the front 500 of the upper frame member 104 and is spaced from the first semicircular plate 200 to form a space therebetween. A portion of the proximate end of the handle 108 extends into the space and includes a pivot hole 506 therein. A pivot pin 502 extends through the pivot hole 506 from the first semicircular plate 200 to the second semicircular plate 202 for pivotally attaching the handle 108 to the front 500 of the upper frame 104. A pivot pin access hole 504 may be provided in one of the plates to aid in assembly of the pivot joint. A spring-loaded detent ball 508 and bias spring 512 are mounted in a recess 510 of the handle 108 such that the spring 512 urges the ball 508 outward from the recess 510. A plurality of spaced detent holes 204 are formed in the first semicircular plate 202 such that as the handle 108 is rotated about the pivot pin 502, the spring-loaded detent ball 508 extends partially into each of the plurality of holes 204. A user can press the extended spring-loaded ball 508 inward at each undesired position to advance the handle 108 to the desired position. The spring-loaded detent ball 508 then extends partially into the associated one of the plurality of holes 204 and maintains the handle 108 in the desired position. A grip 403 may be provided about a distal end of the handle 108 for ergonomic purposes. The handle 108 further includes two telescoping portions, designate by 408 (at the proximate end) and 401 (at the distal end). An adjustment collar 406 is provided to tighten and loosen the telescoping portions 401, 408 relative to each other. Such an arrangement is taught in U.S. Pat. No. 8,422,716, which is hereby incorporated by reference in its entirety.

Figure 5B:
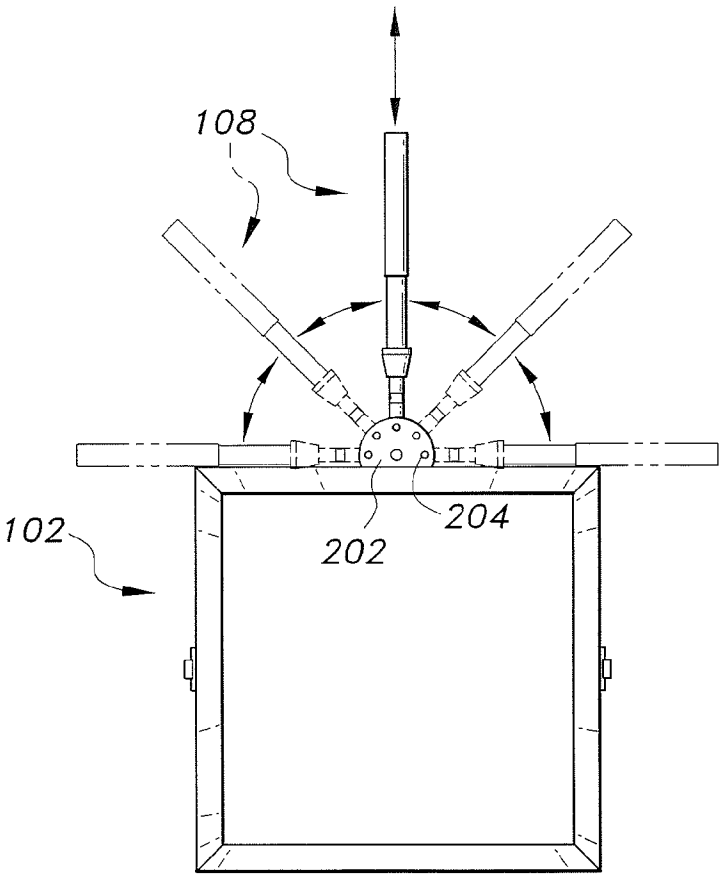
FIGS. 5A-5B are plan views of the trash bag holder of FIG. 1, showing the handle of the holder different positions the handle may be secured in by a detent mechanism.
Figure 5A:
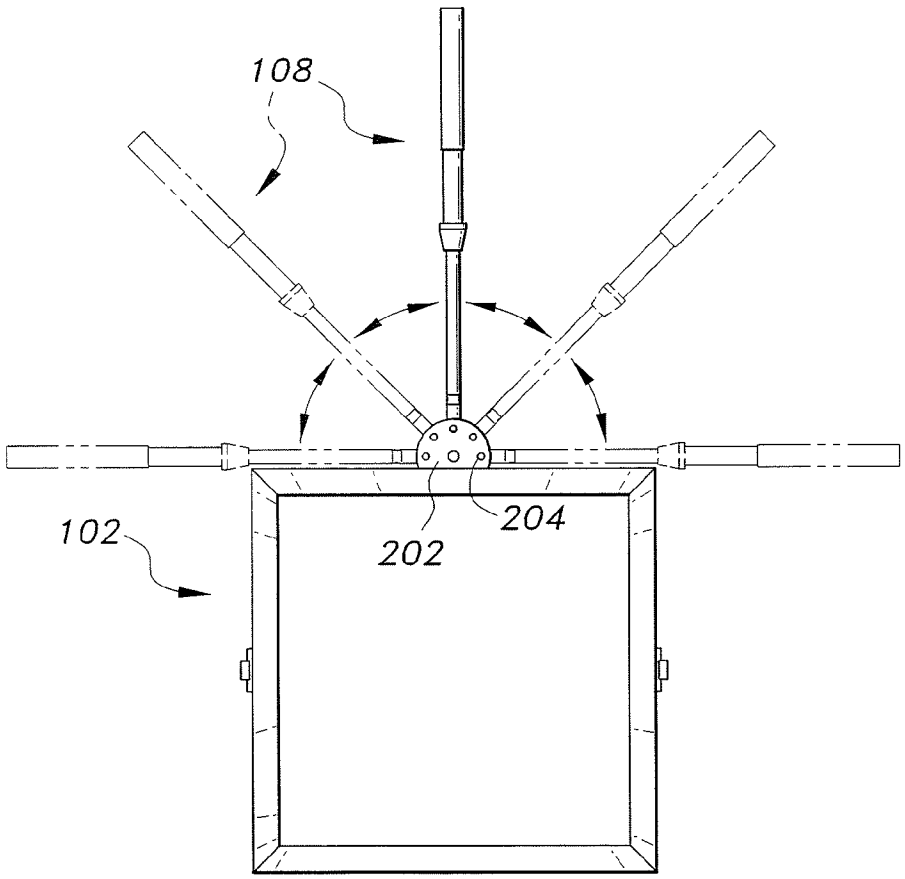

The spaced detent holes 204 permit the handle 108 to be rotated away from the frame assembly 102 at discrete angles. FIGS. 5A-5B show some of the various positions of the handle 108 relative to the main frame 102. In FIG. 5A, the handle 108 is shown axially extended to its greatest length. This position may be useful, for example, when standing to the side and sweeping trash into the bag, as shown in FIG. 1. In FIG. 5B, the handle 108 is shown retracted axially to a shorter length. This position may be useful, for example, when removing trash from a horizontal surface, such as is shown in FIG. 2, when using the trash bag holder 100 very close to the user, or for storage purposes. It should be understood that there are a wide range of relative positions between the handle 108 and the main frame 102, and the trash bag holder 100 is not limited to the examples illustrated.

Figure 6A:
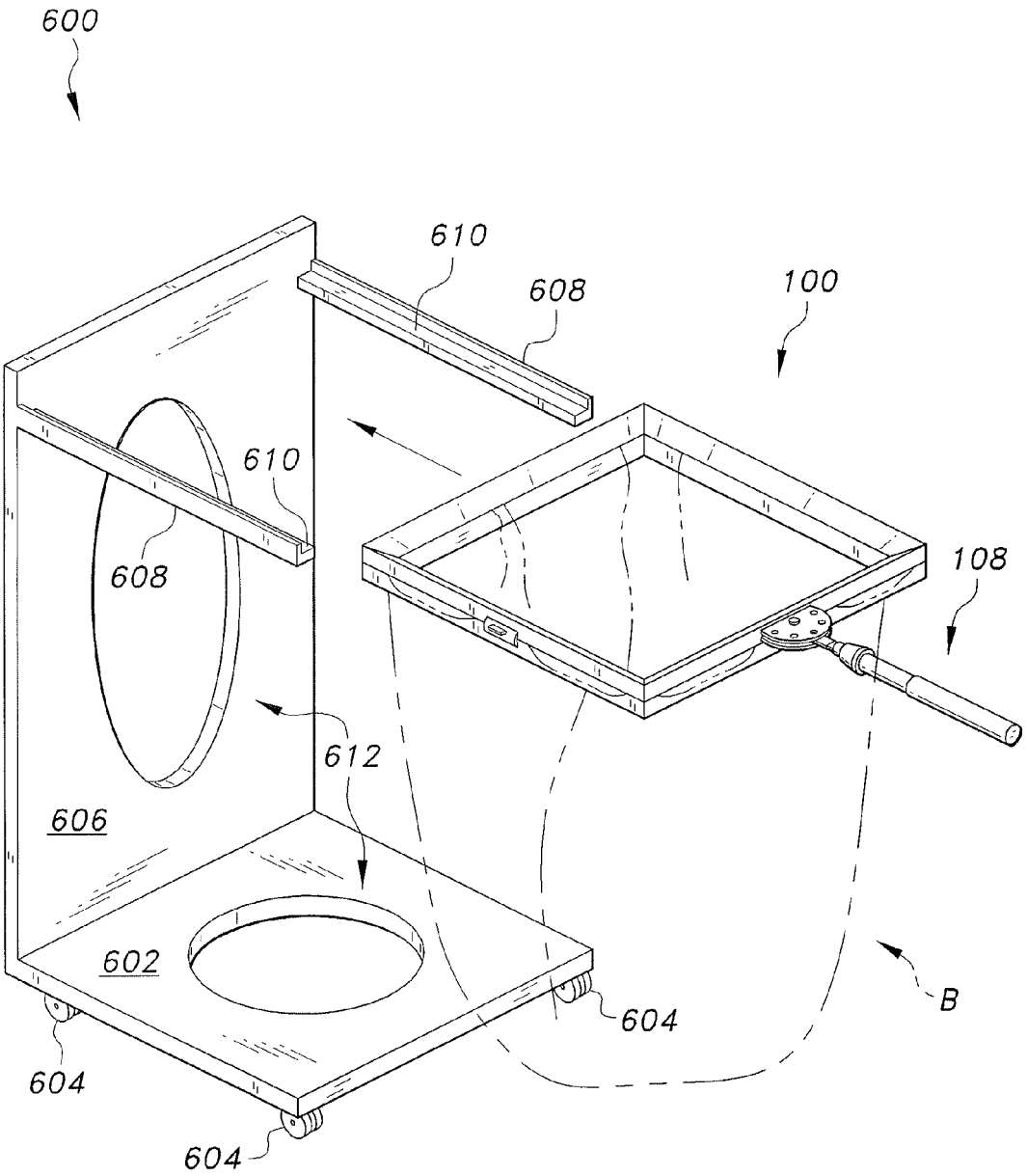
FIG. 6A is a perspective view of the trash bag holder of FIG. 1, shown with the frame assembly exploded from the holder's stand and with the handle in an extended position.
Figure 6B:
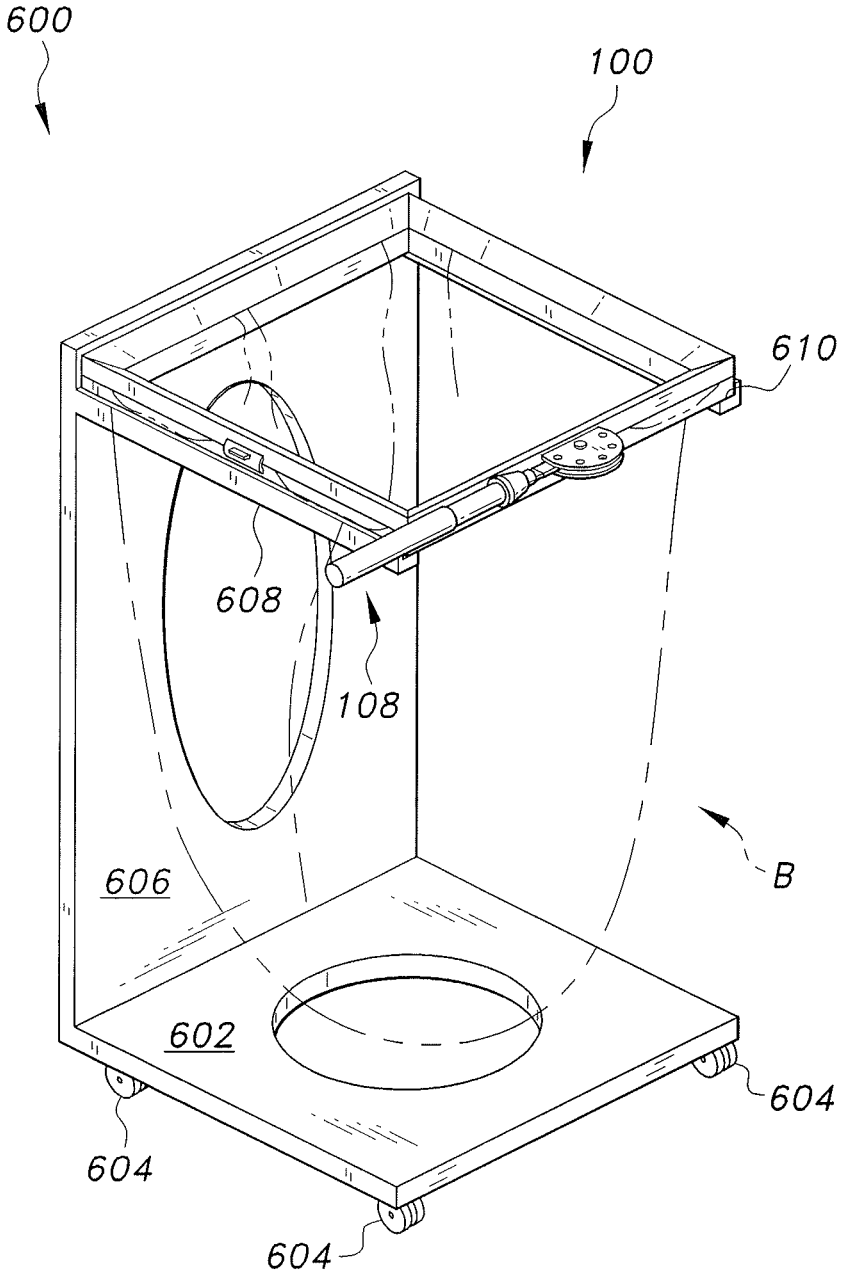
FIG. 6B is a perspective view of the trash bag holder of FIG. 1, shown with the frame assembly resting on the holder's stand and with the handle in a retracted position.
Figure 6C:
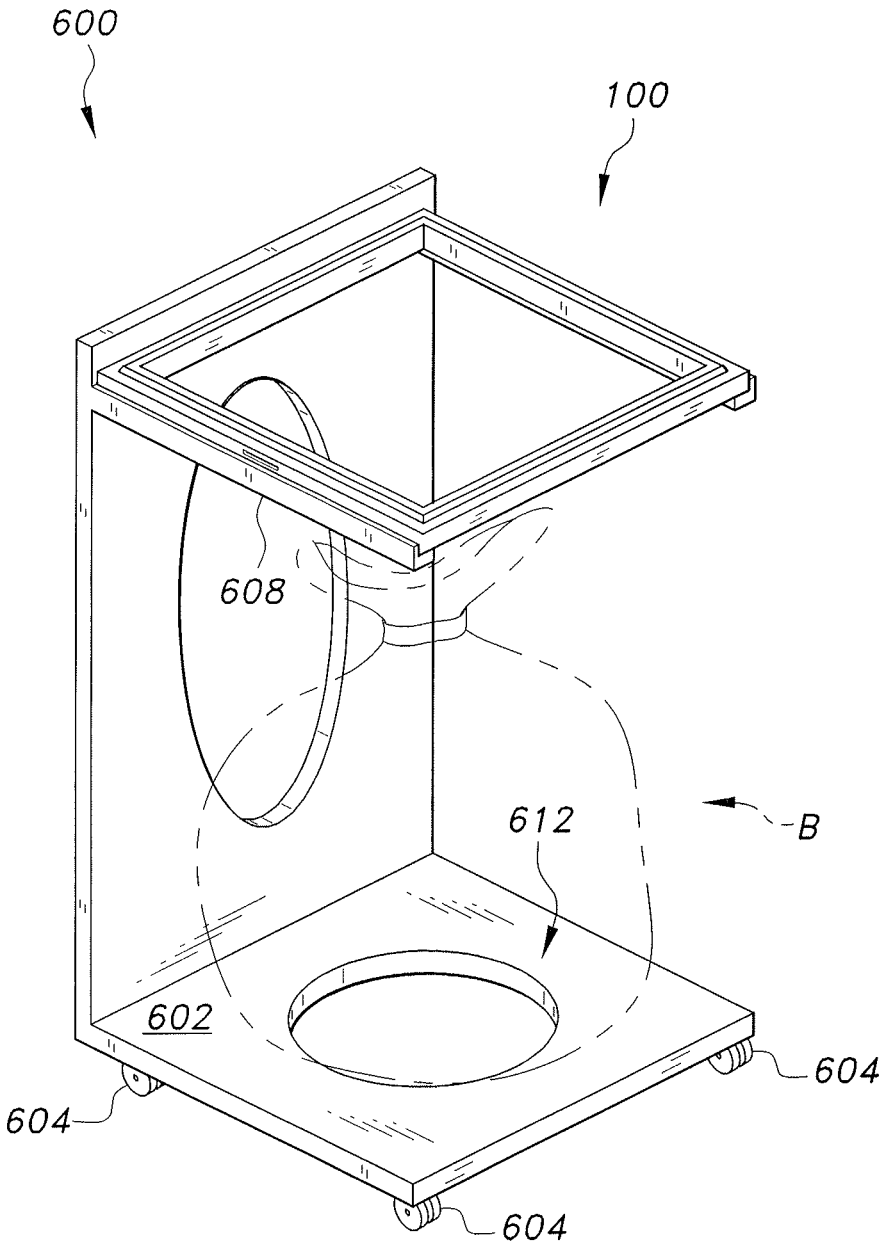
FIG. 6C is a perspective view of the trash bag holder of FIG. 1, shown with the frame assembly resting on the holder's stand and with a trash bag (in phantom) removed from the frame assembly and resting on the stand's base platform.

The trash bag holder 100 may further include an open-frame stand 600, as illustrated in FIGS. 6A-6C. As best seen in FIG. 6A, the stand 600 includes a substantially horizontal bottom board (base platform) 602, a substantially vertical back board (upright) 606 attached to one edge of the bottom board 602, and two substantially horizontal arms 608 extending from and attached to the back board 602. The arms 608 are vertically spaced from the bottom board 602 and are spaced parallel from each other and parallel to and directly above the bottom board 602, such that the frame assembly 102 can be removably supported on ledges 610 defined on the arms 608, while providing access to the trash bag in its open position. The reduced height of the ledges 610 relative to the top of the arms 608 provides lateral stability to the frame assembly 102 when it is supported on the ledges 610. A plurality of caster wheels 604 may be mounted on the bottom surface of the bottom board 602 for assisting in moving the stand. In a preferred embodiment, there are four wheels to provide stability for the rectangular configuration of the stand 600 and holder 100. The back board 606 and the bottom board 602 may each include a central circular opening 612 to reduce the weight and the amount of material of the stand 600.

In FIG. 6A the trash bag holder 100 is shown being advanced toward the stand 600, but not yet engaging the stand 600. In FIG. 6B, the holder 100 is shown supported on the ledges 610 of the arms 608, such that the bag B is held open and supported for use as a portable trash receptacle. The handle 108 is shown retracted in length and rotated to a relatively parallel position to the front of the frame assembly 102. In FIG. 6C the upper frame member 104 has been removed and the lower frame member 106 remains supported on the ledges 610 of the arms 608. The bag B is shown tied with a suitable closure and is supported on the bottom board 602 and partially extending into the central circular opening 612, thereby stabilizing the trash bag B on the stand 600.

It is to be understood that the trash bag holder is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A trash bag holder, comprising:

a substantially rectangular frame assembly including an upper rectangular frame member and a lower rectangular frame member, the frame assembly having a front;

first and second latches selectively clamping the upper frame and the lower frame together and adapted for clamping a mouth of a trash bag sandwiched between the upper and lower frame members open to hold the trash bag open when the latches are fastened; and a telescoping handle, the telescoping handle having a distal end and a proximal end, the proximal end being pivotally attached to the front of the frame assembly, the handle having adjustable length and being pivotal between a position substantially parallel to the front of the frame assembly and a position perpendicular to the front of the frame assembly, wherein a grip is disposed on the distal end of the handle.

2. The trash bag holder according to claim 1, further comprising an open-frame stand having:

a base platform having a back edge;

an upright extending substantially vertically from the back edge of the base platform; and two substantially horizontal arms extending from the upright above and parallel to the base platform, the arms being spaced apart and parallel to each other, said frame assembly being selectively supported on the arms in order to hold the trash bag open above the base platform.

3. The trash bag holder as recited in claim 2, further comprising a plurality of wheels mounted below said base platform for assisting in moving said stand.

4. The trash bag holder as recited in claim 3, wherein said plurality of wheels comprises at least four wheels.

5. The trash bag holder as recited in claim 2, wherein said base platform has a central stabilizing hole defined therein for stabilizing a full trash bag when the trash bag is not clamped in said frame assembly.

6. The trash bag holder as recited in claim 1, wherein the first and second latches each comprise:

a hook member pivotally attached to the upper frame member;

a catch member attached to the lower frame member, the hook member releasably engaging the catch member to fasten the latch.

7. The trash bag holder as recited in claim 6, wherein the first and second latches each further comprise a release lever for disengaging the hook member from the corresponding catch member.

8. The trash bag holder as recited in claim 1, wherein:

the lower frame member has a beveled upper surface; and the upper frame member has a lower surface having a corresponding beveled receptacle defined therein adapted to clamp the trash bag between the frame members in the beveled receptacle.

9. The trash bag holder as recited in claim 1, further comprising:

a first semicircular plate and a second semicircular plate attached to the front of the frame assembly, the plates being spaced apart and having a pivot hole defined therein, the first semicircular plate having a plurality of spaced detent holes defined therein;

a pivot pin, the handle having a portion extending between the spaced apart semicircular plates, the pivot pin extending through the pivot holes and through the portion of the handle between the plates so that the handle is pivotally attached to the frame assembly; and a spring-biased detent ball between the handle and the first semicircular plate, the detent ball selectively engaging a corresponding one of the detent holes to selectively secure the handle at an angle with respect to the front of the frame assembly when the handle is rotated.

10. The trash bag holder as recited in claim 1, wherein the upper frame member has a beveled upper surface for directing trash into the trash bag.

11. A trash bag holder, comprising:

a substantially rectangular frame assembly including an upper rectangular frame member and a lower rectangular frame member, the frame assembly having a front, wherein the upper frame member has a beveled upper surface for directing trash into the trash bag;

first and second latches selectively clamping the upper frame and the lower frame together and adapted for clamping a mouth of a trash bag sandwiched between the upper and lower frame members open to hold the trash bag open when the latches are fastened; and a telescoping handle pivotally attached to the front of the frame assembly, the handle having adjustable length and being pivotal between a position substantially parallel to the front of the frame assembly and a position perpendicular to the front of the frame assembly.

12. A trash bag holder, comprising:

a substantially rectangular frame assembly including an upper rectangular frame member and a lower rectangular frame member, the frame assembly having a front;

first and second latches selectively clamping the upper frame and the lower frame together and adapted for clamping a mouth of a trash bag sandwiched between the upper and lower frame members open to hold the trash bag open when the latches are fastened;

a first plate and a second plate attached to the front of the frame assembly, the plates being spaced apart and having a pivot hole defined therein, the first plate having a plurality of spaced detent holes defined therein;

a telescoping handle pivotally attached to the front of the frame assembly, the handle having adjustable length and being pivotal between a position substantially parallel to the front of the frame assembly and a position perpendicular to the front of the frame assembly, wherein the telescoping handle further includes:

a pivot pin, the handle having a portion extending between the spaced apart plates, the pivot pin extending through the pivot holes and through the portion of the handle between the plates so that the handle is pivotally attached to the frame assembly; and a spring-biased detent ball between the handle and the first plate, the detent ball selectively engaging a corresponding one of the detent holes to selectively secure the handle at an angle with respect to the front of the frame assembly when the handle is rotated.

13. The trash bag holder as recited in claim 12, wherein the first and second plates each have a semicircular configuration.

* * * * *